US006886205B1

(12) United States Patent
Pichon

(10) Patent No.: US 6,886,205 B1
(45) Date of Patent: May 3, 2005

(54) SELF-PROPELLED RUNNING APPARATUS FOR CLEANING AN IMMERSED SURFACE

(75) Inventor: Philippe Pichon, Villeneuve de Riviere (FR)

(73) Assignee: Zodiac Pool Care Europe (FR)

( * ) Notice: Subject to any disclaimer, the term of this patent is extended or adjusted under 35 U.S.C. 154(b) by 81 days.

(21) Appl. No.: 10/451,243

(22) PCT Filed: Dec. 11, 2001

(86) PCT No.: PCT/FR01/03933

§ 371 (c)(1),
(2), (4) Date: Jun. 20, 2003

(87) PCT Pub. No.: WO02/50388

PCT Pub. Date: Jun. 27, 2002

(30) Foreign Application Priority Data

Dec. 21, 2000 (FR) ..... 00 16785

(51) Int. Cl.[7] ..... E04H 4/16
(52) U.S. Cl. ..... 15/1.7
(58) Field of Search ..... 15/1.7, 387, 404, 15/400, 398, 402, 397; 210/169

(56) References Cited

U.S. PATENT DOCUMENTS 3,337,889 A * 8/1967 West ..... 15/1.7
4,402,101 A * 9/1983 van Zyl ..... 15/1.7
5,617,600 A * 4/1997 Frattini ..... 15/1.7
5,842,243 A * 12/1998 Horvath et al. ..... 15/1.7
6,094,764 A * 8/2000 Veloskey et al. ..... 15/1.7
6,155,657 A 12/2000 Erlich et al.
6,473,927 B1 * 11/2002 Sommer ..... 15/1.7

FOREIGN PATENT DOCUMENTS

FR 2 584 442 1/1987
FR 2 693 499 1/1994

* cited by examiner

*Primary Examiner*—Gary K. Graham

(57) ABSTRACT

The invention concerns a self-propelled running apparatus for cleaning an immersed surface, comprising in combination a rigid transverse motor housing (1), two lateral flanges (6) rigidly fixed on either side of the motor housing (1) so as to form a rigid H-shaped frame (72), a front transverse wall (9) removably fixed to said frame (72), a rear transverse wall (10), a base (11) provided with water inlets (66) and a top hood (5) fixed to the frame (72) provided with a top orifice (4) for water evacuation, a unidirectional hydraulic circuit being provided from the inlets (66) between the transverse walls (9, 10), the motor housing (1) and the flanges (6), up to the top orifice (4) of the hood (5).

20 Claims, 6 Drawing Sheets

SELF-PROPELLED RUNNING APPARATUS FOR CLEANING AN IMMERSED SURFACE

Figure 1:
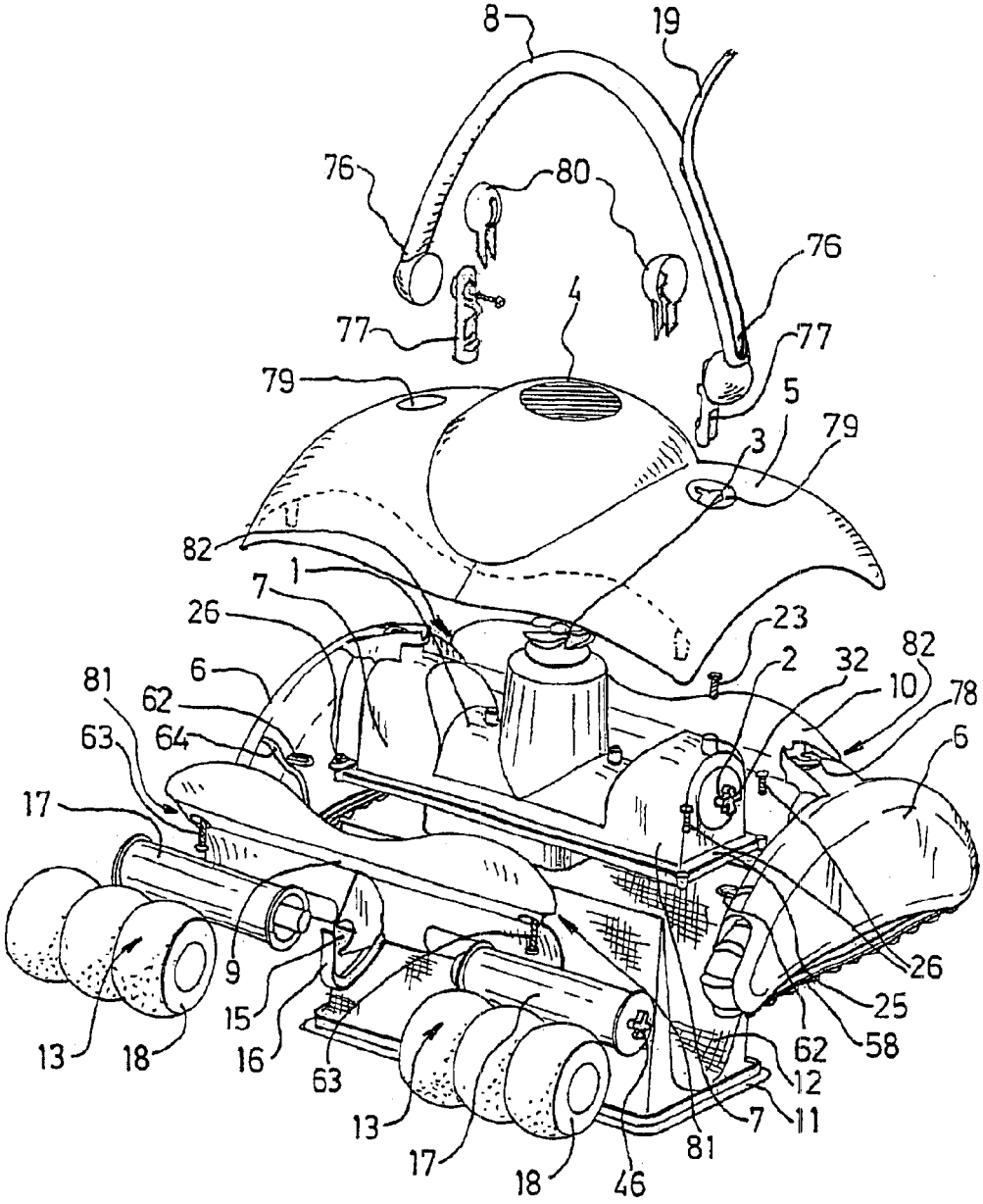

The invention relates to a self-propelled rolling apparatus for cleaning a surface submerged in a liquid, in particular a swimming pool.

Some swimming pool-cleaning apparatuses are of the rolling type, that is to say comprising running members (rollers, wheels, crawler tracks . . . ) which are rotatable around transverse axes of rotation at least substantially parallel to the rolling plane of the apparatus defined by these running members, corresponding to the surface on which the apparatus moves. Such apparatuses may be self-propelled, that is to say incorporate and bear at least one (electric, hydraulic . . . ) motor driving at least one driving shaft, the rotary movement of which has to be transmitted to at least one running member in order to drive it in rotation.

In one particular known version, to which the invention applies, the self-propelled apparatus comprises at least one electric motor which is supplied by a watertight electrical cable immersed in the swimming pool and the output shaft (rotor) of which forms a driving shaft. Such a motorised electric apparatus is also generally provided (cf. for example FR-2,584,442) with an electric pump for drawing up waste and a filtering bag for recovering the waste.

In most cases, the apparatus operates more or less automatically and is generally referred to as a robot.

Such known self-propelled rolling apparatuses with electric motors are relatively heavy, complex, bulky, costly, and have relatively poor hydraulic performance (drawing up of the waste) considering their cost, weight and bulkiness, and they offer few possibilities for design variations.

In general (FR-2,584,442), they consist of a rigid outer shell forming the main frame of the apparatus bearing all of its constituent elements, namely the running members on one hand, and the electric drive motor on the other hand. The hydraulic circuit is generally vertical, rising between a bottom inlet into the shell ard a top outlet from the shell. For access to the interior of the shell, the latter is generally formed of two half-shells assembled to each other at a longitudinal vertical, or horizontal assembly plane. The transmission between the electric motor and the rollers is carried out via lateral, belt-transmission assemblies generally fixed on the side of the shell.

As will be appreciated, with such a structure, the shell, which simultaneously forms the hydraulic circuit and acts as a frame supporting the mechanical members, restricts the external shapes and the design of the apparatus and has to have a robust, heavy and costly construction. The maintenance of the mechanical part is also difficult, time-consuming and complex.

To overcome these problems, it is possible to isolate the hydraulic mechanical part of the apparatus. Provision may thus be made for an apparatus comprising a bottom mechanical frame bearing the electric motor, the rollers and the transmissions, this mechanical frame receiving a top shell forming an S-shaped hydraulic circuit which draws up the water upwards at the front and rear, then downwards in the shell through a filtering bag, before being fed upwards again through a central chimney incorporating a pumping propeller, and being evacuated through a top orifice provided in a removable top cover mounted on the shell. Such an S-shaped hydraulic circuit is complex, bulky, involves sudden changes of the flow direction (upwards, downwards and upwards) causing considerable losses of loud which adversely affects the hydraulic performance and therefore requires an oversized pumping motor.

In addition, the apparatus contains a large "dead" volume of water (volume of water upstream of the filter remaining in the apparatus when it is turned off), thereby making the apparatus particularly heavy and difficult to handle and take out of the water. Moreover, access to the mechanical members for maintenance is still relatively time-consuming and difficult.

The object of the invention is therefore to overcome these disadvantages by providing a self-propelled running apparatus for cleaning a submerged surface, which has a simple, effective, unidirectional hydraulic circuit (without sudden change of the flow direction), but in which the mechanical part is simple, light, robust, does not require a rigid shell and may be common to numerous models of different designs.

The object of the invention is also to provide such an apparatus which can be manufactured and maintained simply, quickly and inexpensively and in particular can be assembled and disassembled quickly and easily.

To this end, the invention relates to a self-propelled rolling apparatus for cleaning a submerged surface, comprising in combination:

- a rigid transverse motor housing enclosing at least one electric motor and having at least one shaft, called the driving shaft, for driving at least one running member, and at least one drive shaft, called the pumping shaft, for driving a pumping member, these drive shafts emerging outside the housing,
- two lateral flanges rigidly fixed on each side of the motor housing and extending longitudinally forwards and rearwards of the motor housing so as to form a rigid, generally H-shaped frame (or above and below), at least one of the flanges being provided with transmission means of the driving movement between a driving shaft projecting laterally from the motor housing and at least one running member having a transverse axis of rotation extending between the two flanges and guided by each flange,
- a front transverse wall extending at the front of the motor housing and between the two flanges while being demountably fixed to the said frame,
- a rear transverse wall extending at the rear of the motor housing and between the two flanges being demountably fixed to the said frame,
- the front transverse wall and rear transverse wall extending at a distance from the motor housing providing a passage for the water, and to form between them and the lateral flanges a bottom opening under the motor housing,
- a base, provided with water inlets and adapted to close the said bottom opening,
- and a top hood fixed to the frame and covering the transverse walls, the flanges and the motor housing, this hood being provided with a top orifice for water evacuation, providing a unidirectional hydraulic circuit from the inlets of the base, at the front and rear between the transverse walls and the motor housing and between the flanges, and up to the top orifice of the hood.

Thus, an apparatus according to the invention has no rigid shell forming the hydraulic circuit. In particular, it should be noted that the lateral flanges of the frame serve as side walls for the hydraulic circuit. The top hood, the transverse walls and the base do not take part in the transmission of the driving movement and are simple and lighter.

Advantageously and according to the invention, the two flanges are similar, the frame being symmetrical with respect to a median longitudinal plane orthogonal to a rolling plane defined by its running members. Advantageously and according to the invention, the frame is symmetrical with respect to a median transverse plane orthogonal to a rolling plane defined by its running members. Thus, the number of different components used to produce an apparatus according to the invention is low. In particular, the two flanges may be identical, and the two transverse walls may be identical.

Advantageously, an apparatus according to the invention comprises at least one front running member extending between the two flanges, at the front of the front transverse wall, outside the hydraulic circuit, and at least one rear running member extending between the two flanges, at the rear of the rear transverse wall, outside the hydraulic circuit. Here again, the front running member(s) may be identical to the rear running member(s). They may be simple rollers guided between the flanges by means of their ends.

Advantageously and according to the invention, at least one of the flanges is formed of a casing with an outer housing enclosing means for transmission of the driving movement in particular a train of pinions.

Advantageously and according to the invention, the two flanges bear transmission means.

In addition, advantageously and according to the invention, the apparatus comprises two independent separate drive motors (a left-hand motor and a right-hand motor), each of these motors having a driving shaft (the apparatus comprising a left-hand driving shaft and a right-hand driving shaft), and two pairs of independent running members, namely a front pair of running members and a rear pair of running members, the two running members (left-hand and right-hand) of the same pair (front or rear) being arranged as a coaxial extension of each other and independent of each other in terms of rotation, one of them being coupled, via transmission means, to one of the two driving shafts, while the other is coupled, via transmission means, to the other driving shaft. The apparatus thus comprises a left-hand front running member and a left-hand rear running member which are coupled to the left-hand driving shaft of the left-hand drive motor; and a right-hand front running member and a right-hand rear running member which are coupled to the right-hand driving shaft of the right-hand drive motor. Consequently, the apparatus may be steered by differential control of the two motors.

The two running members of the same pair extend between the flanges, one being guided by one of the flanges, the other being guided by the other flange, and are advantageously associated and guided axially with respect to each other. Advantageously, they are guided with respect to each other by an assembly of the cylindrical telescopic type, allowing relative rotations. This assembly and/or either or both of the two running members may also be rotationally guided with respect to the opposite transverse wall by a mounting with instant demounting—in particular with a hook—which facilitates the demounting and remounting of the running members, for example in order to change the covering.

Furthermore, advantageously and according to the invention, the flanges have grooves for receiving the lateral end edges of the transverse walls. Consequently, the transverse walls are fixed to the flanges by simply setting in their end edges in the grooves of the flanges. In addition, better tightness between the hydraulic circuit inside the apparatus, which is at low pressure, and the pool outside the apparatus is ensured in a simple way.

In addition, advantageously and according to the invention, each flange is demountably fixed to the motor housing, in particular by means of screws or bolts.

Advantageously and according to the invention, the transverse walls are fixed to the top hood by means of screws or bolts, which clamp the top hood on the transverse walls.

The entire assembly of the flanges to the motor housing, and the transverse walls by setting in the flanges and the top hood by relative clamping may be assembled or disassembled particularly simply, easily and quickly and provides the structure, thus formed, of the apparatus with great rigidity.

In addition, advantageously and according to the invention, the apparatus comprises a carrying handle fixed on the frame—in particular to the flanges—through the hood. This fixing may be realised by hooking, the handle having ends provided with hooks passing through apertures of the hood, with a locking clip inserted behind each hook through the aperture of the hood in order to lock the hook in place with respect to the hood.

In addition, advantageously and according to the invention, the motor housing is moulded as close as possible around the elements which it contains and has rounded shapes promoting the water circulation.

Furthermore, advantageously and according to the invention, the motor housing comprises an upper central pumping motor with a pumping shaft orthogonal to a running plane defined by the running members and driving a pumping propeller arranged outside the motor housing under the orifice of the hood, and capable of generating a flow of water in the apparatus between the water inlets and the top orifice.

According to another advantageous feature of the invention, the base bears a filter interposed in the hydraulic circuit between the bottom water inlets and the top evacuation orifice. Advantageously and according to the invention, the filter extends between the motor housing and each transverse wall.

Furthermore, advantageously and according to the invention, the base is removably fixed with respect to the frame. Advantageously and according to the invention, the base is fixed to the flanges. Advantageously and according to the invention, the base is fixed to the frame by elastic-hooking fixing means.

In addition, advantageously and according to the invention, at least one of the transverse walls is provided with at least one emptying valve allowing the emptying of the hydraulic circuit owing to gravity when the apparatus is withdrawn from the liquid.

The invention also relates to an apparatus characterised in a combination by some or all of the features mentioned above or below.

The apparatus according to the invention is simple, inexpensive, robust, easy and quick to assemble and disassemble, and therefore to repair, maintain and use, may be subject to considerable design variations at less industrial cost (it is sufficient for example to modify the shape of the hood), comprises no or virtually no dead volume of liquid (the hydraulic circuit emptying entirely on withdrawal of the apparatus from the liquid) and is light and easy to handle.

Figure 2:
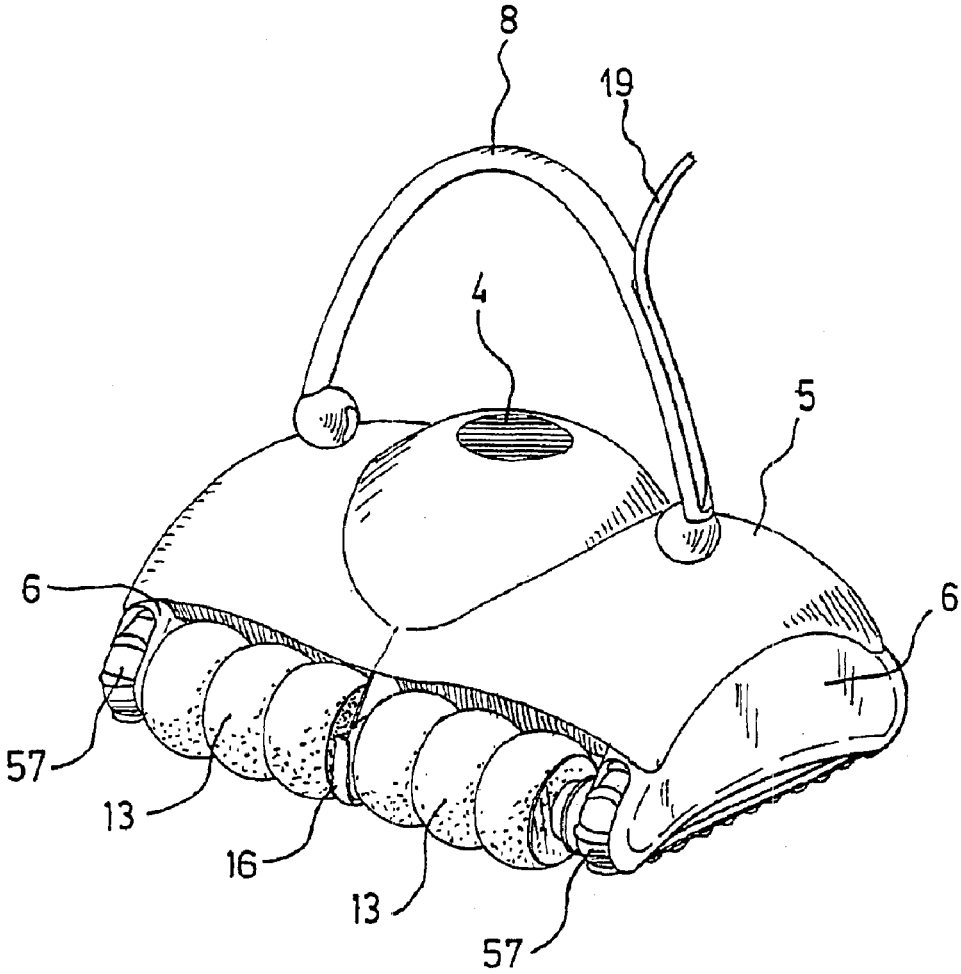
Figure 3:
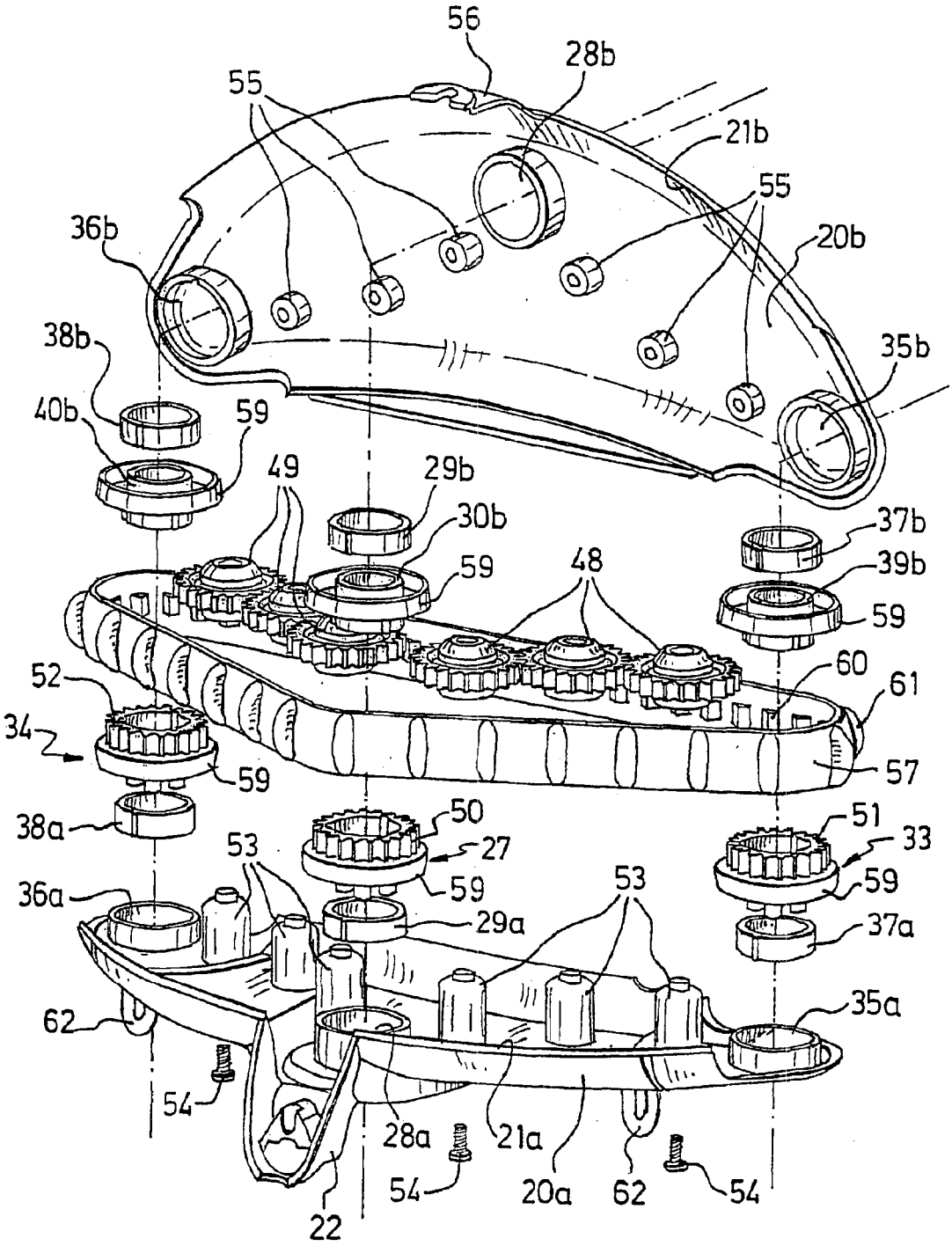
Figure 4:
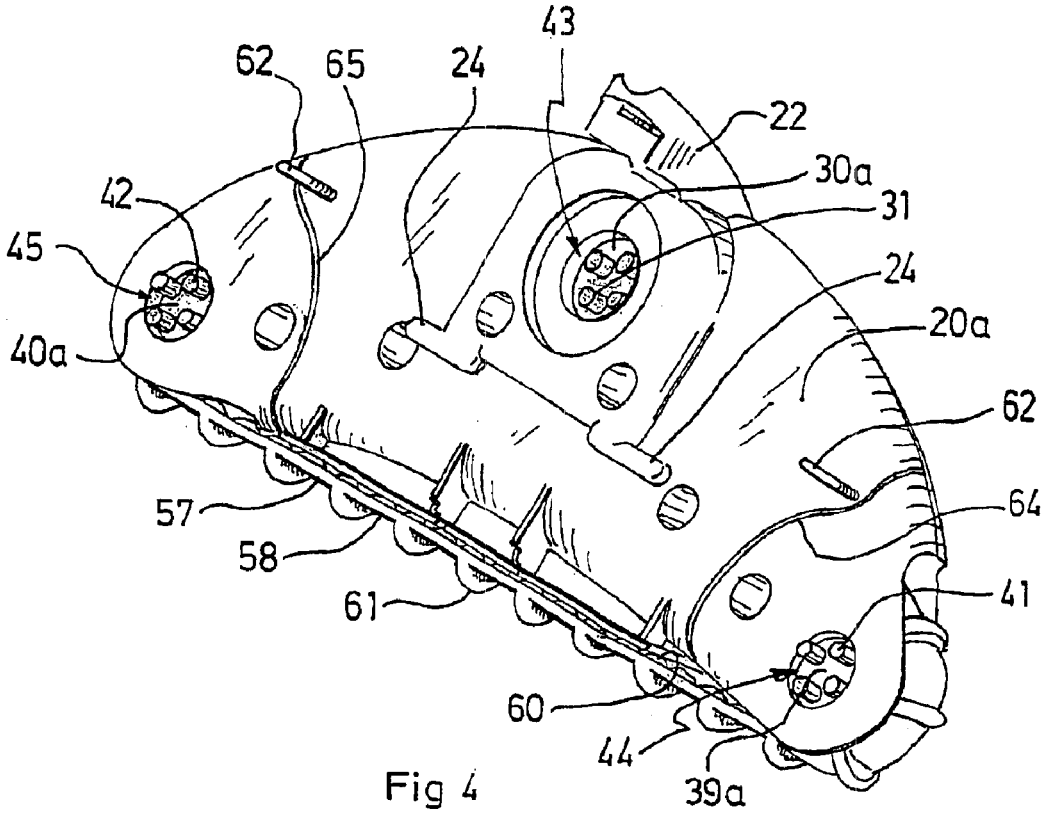
Figure 5:
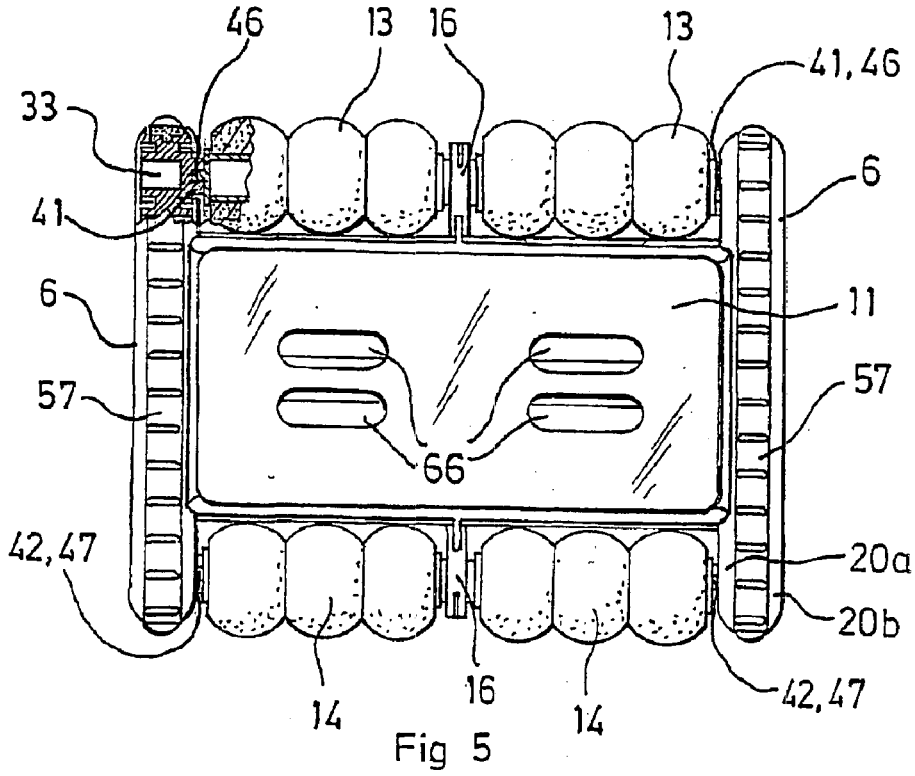
Figure 6:
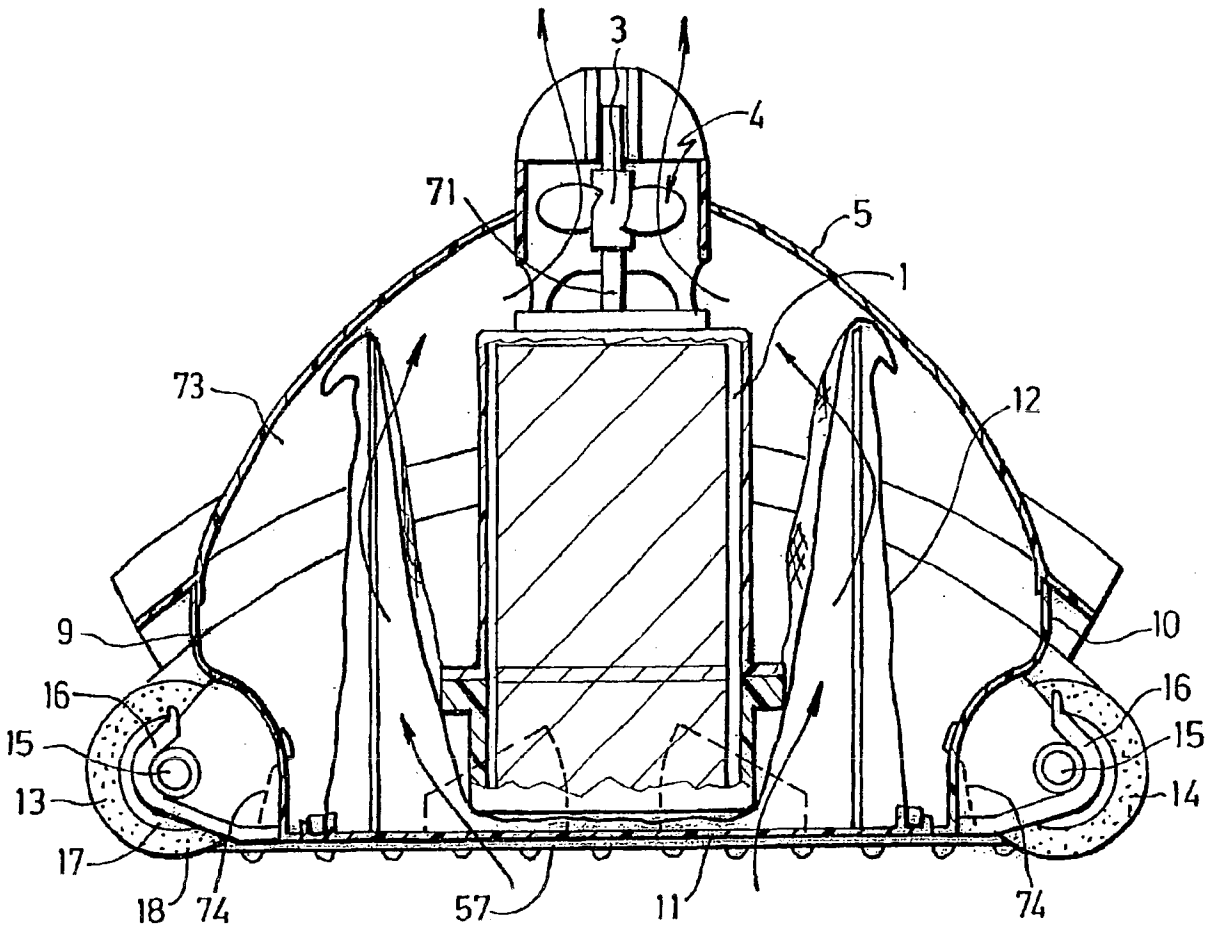
Figure 7:
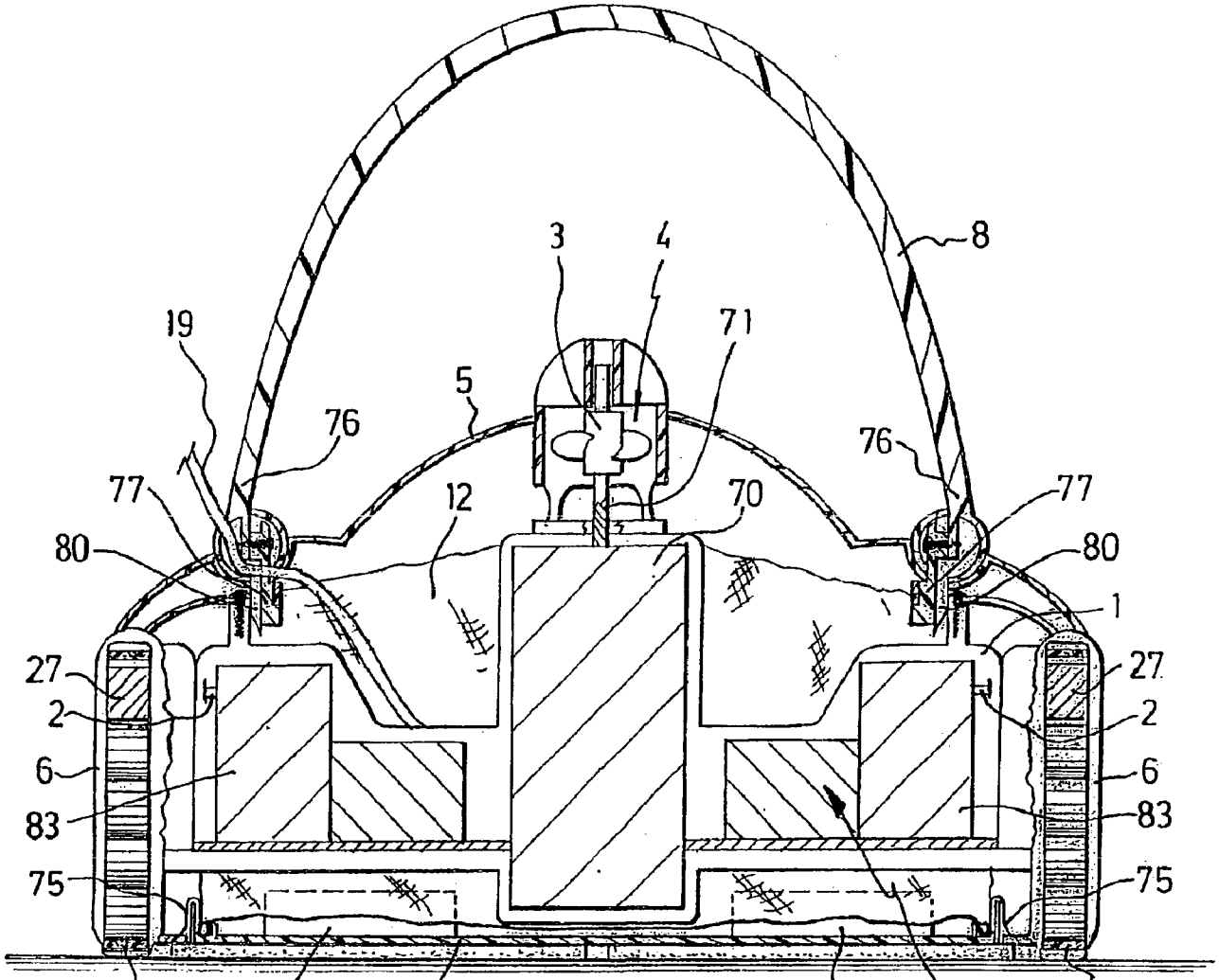

Other objects, features and advantages of the invention will become apparent on reading the following description of an exemplary embodiment shown in the figures, in which:

FIG. 1 is a schematic exploded perspective view of an apparatus according to a preferred embodiment of the invention, FIG. 2 is a schematic perspective view of the apparatus of FIG. 1 in the assembled state, FIG. 3 is a schematic exploded perspective view of a transmission casing according to the invention, FIG. 4 is a schematic perspective view of the casing of FIG. 3 in the assembled state, FIG. 5 is a schematic bottom view with a partial section of the apparatus of FIG. 2, FIG. 6 is a schematic transverse vertical sectional view of the apparatus of FIG. 1, FIG. 7 is a schematic longitudinal vertical sectional view of FIG. 1.

FIGS. 1 and 2 show an electric self-propelled rolling apparatus (or robot) according to the invention, for cleaning a submerged surface, in particular a swimming pool, comprising a central transverse rigid motor housing 1 made of rigid synthetic material enclosing two similar independent electric motors 83, one on each side, each driving a transverse rotary driving shaft 2 which emerges, projecting laterally, outside the motor housing 1. In its central part, the motor housing 1 encloses a third electric motor 70 whose drive shaft, called the pumping shaft 71, emerges vertically upwards outside the motor housing 1 for driving an upper pumping propeller 3 outside the motor housing 1.

The apparatus according to the invention also comprises two lateral transmission casings 6 according to the invention, one on each side. Each transmission casing 6 is fixed rigidly but demountably, in a single-piece assembly, to each lateral end 7, respectively, of the motor housing 1. Each casing 6 forms a lateral flange extending longitudinally forwards and rearwards of the motor casing 1, so as to form a rigid, overall H-shaped frame 72 on which the other members of the apparatus are mounted and fixed, namely a top hood 5, an actuating handle 8; a front transverse wall 9 and rear transverse wall 10 which extend between the two casings 6 and the top hood 5, and at the front and rear, respectively, of the motor housing 1, and delimit between them and with the casings 6, at their bottom part, a bottom opening closed by a base 11 provided with water inlets 66 having valves allowing the water to enter upwards but preventing it from leaving downwards. The base 11 bears a filtering bag 12 incorporated in the enclosure 73 thus formed by the hood 5, the transverse walls 9, 10 and the casings 6. The filtering bag 12 has two pockets extending at the front and rear, respectively, of the motor housing 1, between the motor housing and each transverse wall 9, 10.

The front transverse wall 9 and rear transverse wall 10 are provided, at their bottom part, with nonreturn drain valves 74 adapted to prevent the water from entering the enclosure 73 from outside during the operation of the apparatus, but to allow the water contained in the enclosure 73 to leave, owing to gravity, when the apparatus has been turned off. When the propeller 3 is not active, the water contained in the enclosure 73 is automatically emptied owing to gravity via the drain valves 74 when the apparatus is taken out of the water.

In terms of running members, the apparatus comprises two front rollers 13 (a left-hand front roller and a right-hand front roller), extending between the two casings 6, and at the front of the front transverse wall 9, outside the hydraulic circuit formed in the enclosure 73, and transversely and as an axial extension of each other, and rotatable around a transverse axis parallel to the surface on which they roll, each of these front running members 13 being coupled, respectively, to one of the lateral casings 6; and two rear rollers 14 (a left-hand rear roller and a right-hand rear roller) extending between the two casings 6 and at the rear of the rear transverse wall 10, outside the hydraulic circuit formed in the enclosure 73, and transversely and as an axial extension of each other, rotatable around a transverse axis parallel to the surface on which they run, each of these rear rolling members 14 being coupled, respectively, to one of the lateral casings 6. The two rollers of the same pair of front rollers 13 or rear rollers 14 are independent of each other, in terms of rotation, that is to say not locked in terms of rotation, each of them being driven by one of the motors 83 (left-hand or right-hand), to the driving shaft 2 (left-hand or right-hand) of which it is connected by means of a transmission casing 6.

Each roller 13, 14 comprises a cylindrical main shaft 17, and a peripheral covering 18, for example made of foam and/or formed of brushes, which is mounted so as to be locked in terms of rotation with the shaft 17, but can be replaced in the event of wear. The shafts 17 of the two front rollers 13 or rear rollers 14 are cylinders of revolution and telescope in each other axially so as to be able to be brought closer to each other at the central part of the apparatus in order to be uncoupled from the lateral casings 6 and demounted from the apparatus, or, on the contrary, to be spaced out from each other so as to couple them to the casings 6. The shafts 17 of the rollers 13, 14 are also guided by a central bearing 15, 16 integral with the front wall 9 and arranged between the two front rollers 13 or rear rollers 14. This bearing 15, 16 comprises a cutout 15 for receiving the shaft 17 having the largest diameter of one of the rollers 13, 14, and a locking hook 16 which pivots so as to be able to be swung above the cutout 15 and the shaft 17 for the mounting of the rollers or, on the contrary, moved away from the cutout 15 for the demounting of the rollers 13, 14. The two rear rollers 14 are similar to the front rollers 13, having a transverse axis parallel to that of the front rollers 13, and mounted and driven in a similar fashion as the front rollers 13. The bearings 15, 16 integral with the transverse walls 9, 10 and guiding the rollers 13, 14 are subjected to poor radial force. The two rollers of the same pair are telescopic and therefore guided and held radially with respect to each other while being free in terms of rotation with respect to each other, and are also guided and held at their opposite ends by the casings 6.

The rollers 13, 14 define a rolling plane of the apparatus corresponding to the submerged surface on which they move. The driving shafts 2 of the apparatus are coaxial and parallel to this rolling plane. The pumping shaft 71 of the third motor driving the propeller 3 is orthogonal to this rolling plane, so that the propeller 3 is adapted to create a flow of water in the orthogonal direction in displacement away from the rolling plane (vertically upwards when the submerged surface is horizontal), from the bottom inlets 66 around the motor housing 1 and between the transverse walls 9, 10, the casings 6 and the motor housing 1, and up to a top drain orifice 4 provided in the top hood 5 of the apparatus, through which the water is expelled upwards from the apparatus. The filtering bag 12 extends at the front and rear of the motor housing 1 and its opening is associated with the periphery of the base 11, so that this filtering bag 12 is interposed in the water circuit between the inlets 66 and the outlet orifice 4. The housing 1 may be moulded as close as possible around the motors 70, 83 and members which it contains, in order to achieve greater compactness, an increase in rigidity, and hydrodynamic rounded external shapes. When the propeller 3 is active, the water is driven in an upward movement and can therefore not leave again via the drain valves 74 owing to gravity.

A watertight electrical supply cable 19 is connected to the inside of the motor housing 1, for supplying and controlling the different motors 70, 83, and this cable 19 passes through the top hood 5 via one of the apertures 79 for fixing the handle 8 in order to enable connection to an electric power supply outside the apparatus and the swimming pool.

The two lateral casings 6 are identical. In fact, each casing 6 is symmetrical with respect to a median transverse plane orthogonal to the rolling plane and therefore to the surface on which the apparatus moves. This plane of symmetry is thus, in particular, vertical when this surface is horizontal. The frame 72, and more generally the apparatus, are overall symmetrical with respect to the same median transverse plane orthogonal to the running plane, and this plane of symmetry of the robot coincides with the plane of symmetry of each casing 6. The frame 72 and the apparatus are also overall symmetrical with respect to a median longitudinal plane orthogonal to the running plane.

Each transmission casing 6 comprises an outer rigid housing 20 (the other elements of the casing 6 being incorporated in this housing 20). This housing 20 is formed of two half-shells 20*a*, 20*b*—an inner half-shell 20*a* closest to the motor housing 1 of the apparatus and fixed to the motor housing 1 of the apparatus, and an outer half-shell 20*b* farthest from the motor housing 1 of the apparatus. Each half-shell extends at least essentially orthogonally to the rolling plane and in the longitudinal direction, and the two half-shells 20*a*, 20*b* are assembled to each other at an overall longitudinal, peripheral plane 21*a*, 21*b*. The half-shells 20*a*, 20*b* are made of moulded rigid synthetic material.

The inner half-shell 20*a* comprises a median top bracket 22 extending transversely towards the centre of the apparatus enabling it to be fixed by means of a screw 23 to the motor housing 1, above the driving shaft 2. The handle 8 has two ends 76, each of them being provided with a hook 77 adapted to be engaged in an aperture 78 of the bracket 22 and hooked onto this bracket 22. The hood 5 is provided with apertures 79 allowing the hooks 77 to pass through the hood 5, and the insertion of locking clips 80 adapted to lock the hooks 77 in the hooking position. Each aperture 79 of the hood 5 is larger than the hook 77, so that a locking clip 80 may be inserted into this aperture 79 at the rear of the hook 77, between the hook 77 and the opposite edge of the aperture 79, in order to push the hook 77 back laterally into the position in which it is hooked onto the bracket 22. To remove the handle 8, it is thus necessary to remove the locking clips 80 by withdrawing them axially from the apertures 79 of the hood 5, thereby allowing the hooks 77 to be pushed back laterally in the aperture 78 of the brackets 22 and in the apertures 79 of the hood 5, in order to disengage them from the brackets 22 and then withdraw them axially from these apertures 78, 79. To remount the handle 8, the opposite operations are performed.

The handle 8 is thus demountably fixed on the brackets 22 of the casings 6, and therefore on the frame 72, through the hood 5. It should be noted that this fixing of the handle 8 to the frame 72 also secures the hood 5 to the frame 72, the hooks 77 and clips 80 having an outer part larger than the apertures 79 of the hood 5 so that the hood 5 is held against the brackets 22 of the casings 6.

The inner half-shell 20*a* also comprises two bottom lateral brackets 24 which also extend transversely towards the centre of the apparatus in order to be placed above a lateral bottom shoulder 25 of the motor housing 1 and to be fixed thereto by means of screws 26. Between the brackets 22, 24, the inner half-shell 20*a* is shaped so as to receive the lateral end 7 of the motor housing 1, the driving shaft 2 being able to be coupled to an input journal 27 of the casing 6 accessible via an aperture 43 passing through the inner half-shell 20*a*, axially opposite the driving shaft 2.

The input journal 27 is mounted so as to be freely rotatable with respect to the casing 6, between the two half-shells 20*a*, 20*b*, around a transverse axis of rotation, and receives the driving movement from the driving shaft 2. To this end, each half-shell 20*a*, 20*b* defines a cylindrical seat 28*a*, 28*b* which receives a ring 29*a*, 29*b*, made of synthetic antifriction material, which in turn receives an axial cylindrical extension 30*a*, 30*b* of the input journal 27 allowing its rotational guidance in the ring 29*a*, 29*b*.

The cylindrical axial extension 30*a* extending from the side of the inner half-shell 20*a* is extended by means of four positive-locking pins 31 forming means for demountable coupling to the driving shaft 2. The driving shaft 2 is in turn provided with a positive-locking cross 32 adapted to receive the positive-locking pins 31 of the input journal 27 when the casing 6 is in place on the motor housing 1. The positive-locking pins 31 and the cross 32 thus produce means for demountable coupling by simple relative movement into place, of the positive clutch type, the axially extending pins 31 engaging in mating cutouts of the cross 32.

The casing 6 also comprises two output journals 33, 34, namely a front output journal 33 and a rear output journal 34, adapted to be coupled, through the housing 20, to the shaft 17 of one of the front rollers 13 or rear rollers 14, respectively. Each output journal 33, 34 is freely rotatable around a transverse axis of rotation, like the input journal 27. The front output journal 33 and rear output journal 34 are identical with the input journal 27 and are guided with respect to the housing 20 of the casing 6, like the input journal, by means of front cylindrical seats 35*a*, 35*b* and rear cylindrical seats 36*a*, 36*b* provided in the half-shells 20*a*, 20*b*, and of front rings 37*a*, 37*b* made of antifriction material and rear rings 38*a*, 38*b* made of antifriction material, each output journal 33, 34 comprising a cylindrical axial extension 39*a*, 39*b* and 40*a*, 40*b*, respectively, which is engaged in the corresponding ring 37*a*, 37*b*, 38*a*, 38*b*. The two output journals 33, 34 also comprise, on the inner side of the apparatus, positive-locking pins 41 and 42, respectively, which are adapted for the coupling of the journal 33, 34 to a positive-locking cross 46 and 47, respectively, which extends at the opposite lateral axial end of the shaft 17 of the roller 13, 14. The positive-locking pins 31, 41, 42 of the different journals 27, 33, 34 extend through circular apertures 43, 44, 45 provided through the inner half-shell 20*a* in order to enable cooperation with the opposite positive-locking crosses 32, 46, 47 and provide the demountable coupling through the housing 20. The input journal 27 and output journals 33, 34 may be formed of identical components, thereby enabling a reduction of the manufacturing costs.

Between the input journal 27 and each of the output journals 33, 34, the casing 6 comprises a train of successive pinions 48, 49 which mesh in pairs, mounted so as to be freely rotatable around transverse axes of rotation (parallel in pairs and to the axes of rotation of the journals 27, 33, 34), and mesh on the one hand with a toothed wheel 50 of the input journal 27 and on the other hand with a toothed wheel 51 and 52, respectively, of the output journal 33 and 34, respectively. Preferably, each train of pinions 48, 49 comprises an uneven number of pinions and the different pinions have the same diameter. The different pinions may thus be identical, in order to reduce the manufacturing costs. When the driving shaft 2 is coupled to the input journal 27, it drives it in rotation, and each of the output journals 33, 34 is also driven in rotation in the same direction and at the same speed by the trains of pinions 48, 49. The axes of rotation of the different pinions 48, 49 can be simply formed of cylindrical transverse extensions 53 adapted to receive a cylindrical bore of the different pinions, these extensions 53 extending outwards from the inner half-shell 20*a*, with which they are integral. Preferably, the inner half-shell 20*a* and outer half-shell 20*b* are joined to each other by screws 54 passing through the axes of rotation of the pinions 48, 49, that is to say through the transverse extensions 53. In this case, the different pinions 48, 49 are provided with an aperture for the passage of these assembly screws 54, and the outer shell 20*b* comprises studs 55 which abut against the axial end of the transverse extensions 53 formed by the inner half-shell 20*a*, these studs 55 being adapted to receive the self-tapping screws 54, in such a way that their threads are in engagement with these studs 55 which act as inside threads.

In a variant (not shown), or in combination, the studs may be non-demountably secured (welding, adhesive bonding . . . ) to the extensions 53, thus, the half-shells 21*a*, 20*a* being incapable of being disassembled.

The inner half-shell 20*a* also comprises grooves 64 and 65, respectively, for receiving the lateral end edges 81 of the front transverse wall 9 and 82 of the rear transverse wall 10, and the bottom lateral brackets 62 are provided with apertures through which pass screws 63 allowing the assembly of the transverse walls 9, 10, the casings 6 and the hood 5. The transverse walls 9, 10 are therefore fitted in the grooves 64, 65 of the casings 6 and extend between these two casings 6 over the entire height of the casings 6 at the level of the grooves 64, 65. The screws 63 pull the transverse walls 9, 10 and the hood 5 towards each other on the casings 6. In the example shown, they are introduced into apertures of the transverse walls 9, 10 in order to be screwed into screwing studs forming inner threads of the hood 5.

The base 11 may be fixed on the transverse walls 9, 10 and/or the lateral casings 6 by screws and/or elastic hooks or other demountable fixing means so as to close the bottom opening formed by the transverse walls 9, 10 and the lateral casings 6. The base 11 is removably fixed to the frame 72, in particular to the lateral casings, 6, by means of elastic hooks 75 cooperating with a groove 76 integral with the inner half-shell 20*a*. The transverse walls 9, 10 and the top hood 5 are carried by the casings 6 by means of the grooves 64, 65 and the brackets 62 and screws 63. To disassemble the apparatus, for example for a maintenance operation, it is sufficient to remove the rollers 13, 14 by moving away the hooks 16, then removing the screws 63 and withdrawing the clips 80 in order to demount the handle 8. The transverse walls 9, 10 and the hood 5 can be dissociated from the frame 72. To demount the transverse walls 9, 10, it is necessary to demount one casing 6 (owing to the grooves 64, 65). The cable 19 passes through the hood and does not allow the complete separation of the hood 5 and the frame 72. Nevertheless, it is sufficient to slide the hood 5 along the cable 19, so that the maintenance is possible and easy. Assembly is effected by performing the opposite operations. The design of the apparatus may have numerous variants.

The outer half-shell 20*b* also preferably has a central top bracket 56 intended to extend above the central top bracket 22 of the inner half-shell 20*a* and fixed with it to the motor housing 1 above the driving shaft 2.

Furthermore, the casing 6 according to the invention advantageously comprises a crawler track 57 formed of an endless belt passing around the input journal 27 and output journals 33, 34 in order to be driven to move continuously by means of these journals 27, 33, 34 and form a longitudinal bottom strand 58 for contact with the ground, acting as a running member driven by the apparatus. For guidance of the crawler track 57, each journal 27, 33, 34 advantageously comprises two lateral parallel flanges 59 perpendicular to the axis of rotation of the journal 27, 33, 34, on either side of the toothed wheel 50, 51, 52, in order to form a roller for receiving and driving the crawler track 57. The latter advantageously comprises inner notches or teeth 60 adapted to be inserted between the two flanges 59. Similarly, the crawler track 57 advantageously comprises outer notches or teeth 61, or any other equivalent antisliding member adapted to contact the ground. Such a lateral crawler track facilitates the driving of the apparatus when passing over stairs or on changes of incline or on sloping walls.

The different pinions 48, 49, the journals 27, 33, 34 and the half-shells 20*a*, 20*b* may be produced entirely from rigid synthetic material, and the crawler track 57 from flexible synthetic material, so that the transmission casing 6 according to the invention is made entirely of synthetic material, with the possibly exception of the assembly screws 23, 26 (for mounting the casing 6 on the apparatus) and 54 for assembly of the half-shells 20*a*, 20*b*. These screws 23, 26, 54 may, however, also be produced from synthetic material. The whole of the transmission thus produced is not subject to corrosion and is highly reliable when operating in water. The apparatus according to the invention has no moving metal components or metal friction members. All the movable (rotary) elements necessary for the transmission of the driving movement from the driving shafts 2 to the running members (rollers 13, 14 and crawler track 57) are entirely incorporated in the two lateral casings 6 and carried by these casings 6. If one of the casings 6 requires a maintenance operation, it is easy to demount it from the apparatus and replace it with a new one, then repair the casing in the workshop. During the repair, the apparatus remains operational in the swimming pool.

The different casings 6 are produced with a very small number of different components and their manufacturing cost is low. The same applies to the apparatus according to the invention.

The invention may have numerous variant embodiments other than the preferred embodiment shown. In the simplified versions, the transmission of the driving movement between the input journal 27 and each output journal 33, 34 may be provided only via the crawler track 57 which acts as a drive belt (the casing in this case having no gear trains). The number of pinions of the gear trains may differ from three. The same applies to the number of output journal(s) which may differ from two (a single output journal or more than two output journals). The output journals may drive not rollers, but drive shafts locked in terms of rotation with wheels or rollers . . . or even be directly coupled to running members without a separate drive shaft (for example to end flanges of these wheels, rollers . . . ). The apparatus according to the invention may comprise running members which are not motorised (mounted free in terms of rotation) and/or running members coupled successively to one another and not directly independently to a transmission casing. An apparatus according to the invention may comprise only one drive motor, one driving shaft and one lateral transmission casing, the other lateral casing having no transmission means and serving only to guide the running members and, if appropriate, the crawler track. On the contrary, in the preferred illustrated version, the apparatus according to the invention comprises two drive motors 83, one on each side, and two lateral transmission casings 6, both provided with transmission means 48, 49, 57. In this case, it is possible to control the apparatus according to the speed of each motor 83.

The maintenance of the transmission of an apparatus according to the invention is reduced and simple.

What is claimed is:

1. A self-propelled rolling apparatus for cleaning a submerged surface, comprising in combination:

a rigid transverse motor housing (1) enclosing at least one electric motor (70, 83) and having at least one drive shaft, called the driving shaft (2), for driving at least one running member (13, 14), and at least one drive shaft (71), called pumping shaft (71), for driving a pumping member (3), these drive shafts (2, 71) emerging outside the housing (1), two lateral flanges (6) rigidly fixed on each side of the motor housing (1) and extending longitudinally forwards and rearwards of the motor housing (1) in order to form a rigid, generally H-shaped frame (72), at least one of the flanges (6) bearing means (48, 49, 57) for transmission of the driving movement between a driving shaft (2) projecting laterally from the motor housing (1) and at least one running member (13, 14) having a transverse axis of rotation extending between the two flanges (6) and guided by each flange (6), a front transverse wall (9) extending at the front of the motor housing (1) and between the two flanges (6) being demountably fixed to the said frame (72), the front transverse wall (9) and rear transverse wall (10) extending at a distance from the motor housing (1) in order to provide a passage for the water, and to form, between them and the lateral flanges (6), a bottom opening under the motor housing (1), a base (11) provided with water inlets (66) and adapted to close the said bottom opening, and a top hood (5) fixed to the frame (72) and covering the transverse walls (9, 10), the flanges (6) and the motor housing (1), this hood (5) being provided with a top orifice (4) for water evacuation, in order to provide a unidirectional hydraulic circuit from the inlets (66) of the base (11), at the front and rear between the transverse walls (9, 10) and the motor housing (1) and between the flanges (6), and up to the top orifice (4) of the hood (5).

2. An apparatus as claimed in claim 1, wherein the two flanges (6) are similar, the frame (72) being symmetrical with respect to a median longitudinal plane orthogonal to a running plane defined by its running members (13, 14).

3. An apparatus as claimed in claim 1, wherein the frame (72) is symmetrical with respect to a median transverse plane orthogonal to a running plane defined by its running members (13, 14).

4. An apparatus as claimed in claim 1, which comprises at least one front running member (13) extending between the two flanges (6), at the front of the front transverse wall (9), outside the hydraulic circuit.

5. An apparatus as claimed in claim 1, which comprises at least one rear running member (14) extending between the two flanges (6), at the rear of the rear transverse wall (10), outside the hydraulic circuit.

6. An apparatus as claimed in claim 1, wherein at least one of the flanges (6) is formed of a casing (6) having an outer housing which encloses means (48, 49, 57) for transmission of the driving movement.

7. An apparatus as claimed in claim 1, wherein the two flanges (6) each bear a transmission means (48, 49, 57).

8. An apparatus as claimed in claim 1, which comprises two independent separate drive motors (83), each of these motors having a driving shaft (2), and two pairs of independent running members (13, 14), namely a front pair of running members (13) and a rear pair of running members (14), the two running members of the same pair being arranged as a coaxial extension of each other and independent of each other in terms of rotation, one of them being coupled, via transmission means, to one of the two driving shafts, while the other is coupled, via transmission means, to the other driving shaft.

9. An apparatus as claimed in claim 1, wherein the flanges (6) have grooves (64, 65) for receiving the lateral end edges (81, 82) of the transverse walls (9, 10).

10. An apparatus as claimed in claim 1, wherein each flange (6) is demountably fixed to the motor housing (1), in particular by means of screws or bolts (23).

11. An apparatus as claimed in claim 1, wherein the transverse walls (9, 10) are fixed to the top hood (5) by means of screws or bolts (63) which clamp the top hood (5) on the transverse walls (9, 10).

12. An apparatus as claimed in claim 1, which comprises a carrying handle (8) fixed on the frame (72) through the hood (5).

13. An apparatus as claimed in claim 1, wherein the motor housing (1) is moulded as close as possible around the elements which it contains and has rounded shapes promoting the water circulation.

14. An apparatus as claimed in claim 1, wherein the motor housing (1) comprises a central pumping motor (70) below a pumping shaft (71) orthogonal to a rolling plane defined by the running members and driving a pumping propeller (3) arranged outside the motor housing (1) under the orifice (4) of the hood (5), and capable of generating a flow of water in the apparatus between the water inlets (66) and the top orifice (4).

15. An apparatus as claimed in claim 1, wherein the base (11) bears a filter (12) interposed in the hydraulic circuit between the bottom water inlets (66) and the top evacuation orifice (4).

16. An apparatus as claimed in claim 15, wherein the filter (12) extends between the motor housing (1) and each transverse wall (9, 10).

17. An apparatus as claimed in claim 15, wherein the base (11) is removably fixed with respect to the frame (72).

18. An apparatus as claimed in claim 15, wherein the base (11) is fixed to the flanges (6).

19. An apparatus as claimed in claim 15, wherein the base (11) is fixed to the frame (72) by elastic-hooking fixing means (75).

20. An apparatus as claimed in claim 1, wherein at least one of the transverse walls (9, 10) has at least one drain valve (74) allowing the emptying of the hydraulic circuit owing to gravity when the apparatus is withdrawn from the liquid.

* * * * *